US005687510A

United States Patent [19]

Basista

[11] Patent Number: 5,687,510

[45] Date of Patent: Nov. 18, 1997

[54] GUTTERING ARRANGEMENT

[75] Inventor: Jacek Lech Basista, Tunbridge Wells, England

[73] Assignee: Hunter Plastics Limited, London, England

[21] Appl. No.: 510,707

[22] Filed: Aug. 3, 1995

[51] Int. Cl.[6] ..... E04D 13/068; F16B 2/20

[52] U.S. Cl. ..... 52/11; 52/726.1; 403/301

[58] Field of Search ..... 52/11, 12, 726.1; 403/300, 301, 314

[56] References Cited

U.S. PATENT DOCUMENTS

| | | | |
|---|---|---|---|
| 4,305,236 | 12/1981 | Williams | 52/11 |
| 4,646,487 | 3/1987 | Andersson | 52/11 |
| 4,954,015 | 9/1990 | McGowan | 52/11 X |
| 5,038,528 | 8/1991 | Brant | 52/11 |

FOREIGN PATENT DOCUMENTS

| | | | |
|---|---|---|---|
| 1244837 | 9/1971 | United Kingdom | 52/11 |
| 2066872 | 7/1981 | United Kingdom | E04D 13/06 |
| 1603818 | 12/1981 | United Kingdom | 52/11 |
| 1603819 | 12/1981 | United Kingdom | 52/11 |
| 1603870 | 12/1981 | United Kingdom | 52/11 |
| 2164967 | 4/1986 | United Kingdom | E04D 13/06 |
| 2185502 | 7/1987 | United Kingdom | E04D 13/06 |
| 2217748 | 11/1989 | United Kingdom | E04D 13/06 |

*Primary Examiner*—Michael Safavi
*Attorney, Agent, or Firm*—Mark R. Wisner

[57] ABSTRACT

In a guttering arrangement, a guttering element defines a seat adapted to receive an end of a length of guttering. The seat is provided with a channel receiving a sealing strip intended to be in sealing engagement with the exterior of the length of guttering. The element is provided with two separate clips mounted on the element, each clip having a portion directed inwardly across the seat adapted to engage and retain an edge of the said length of guttering. Each clip has a portion defining connecting formations adapted to engage corresponding co-operating connecting formations formed on the exterior of the part of the element defining the seat. The clip has a limited degree of movement.

16 Claims, 6 Drawing Sheets

GUTTERING ARRANGEMENT

Figure 1:
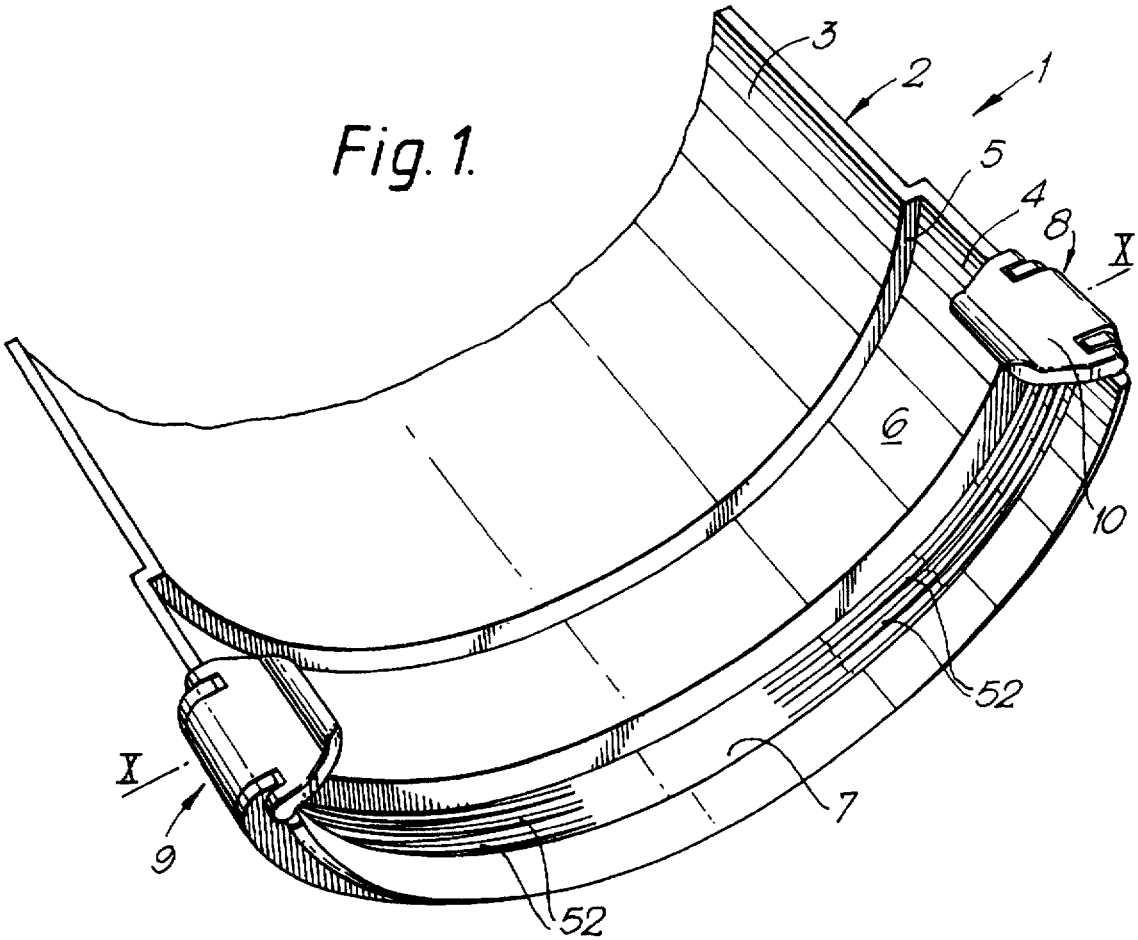

The present invention relates to a guttering arrangement and in particularly, relates to a guttering element incorporating a gutter retaining and sealing means.

Various guttering elements may incorporate a gutter retaining and sealing means. For example, a guttering element in the form of a length of guttering may be provided with such a gutter retaining and sealing means provided at one end to enable the element to be connected to another similar length of guttering. Alternatively, a support bracket which is to be located where two lengths of guttering are to be joined may comprise two gutter retaining and sealing means adapted to retain and seal the ends of the two lengths of guttering. Other guttering elements may incorporate a gutter retaining and sealing means, such as an end stop adapted to be mounted at the end of a run of guttering, a corner connector adapted to join two lengths of guttering which extend at 90° to each other (or any other specific angle) at a corner, and also an element incorporating a down-pipe spout.

It is to be understood that the invention relates to a new retaining and sealing means which may be incorporated in any appropriate type of guttering element including all the various types of element outlined above.

Where a length of guttering is to be connected to another guttering component, such as another length of guttering or a bracket or other element as described above, the end of the length of guttering must be securely retained, and a good seal must be created. The system should be such that the guttering can be assembled easily. However, it is desirable that the guttering should be moulded as cheaply and as economically as possible.

It has been proposed previously to provide many different guttering arrangements, each with a unique gutter retaining and sealing means. Many of the prior arrangements have been relatively complex, involving the use of complicated moulding tools. Other arrangements appear to be simpler, incorporating integral lips provided on the gutter adapted to be snapped over the opposed edges of a length of guttering, but such arrangements may require multi-part tools for their fabrication, leading to high manufacturing costs.

The present invention seeks to provide a guttering arrangement in which a guttering element is provided with gutter retaining and sealing means which operate in a satisfactory manner, the arrangement being such that the components can be moulded relatively cheaply, the design being unobtrusive.

According to this invention there is provided a guttering arrangement including a guttering element defining a seat adapted to receive an end of a length of guttering, the seat being provided with a channel receiving a sealing strip to be in sealing engagement with the exterior of said length of guttering, the said element being provided with two separate clips mounted on the component, each clip having a portion directed inwardly across the seat adapted to engage and retain an edge of the said length of guttering, each clip having a portion defining connecting formations adapted to engage corresponding connecting formations formed on the exterior of the part of the element defining said seat, each clip, when engaging and retaining said edge of said length of guttering, having a limited degree of movement.

Preferably the connecting formations on the clip are provided on a portion of the clip which is received in a recess defined in the exterior of a rib protruding from the underside of the seat and accommodating said channel.

Conveniently movement of the clip in one sense is limited by engagement of faces of the clip and the element defining or associated with the connecting formations.

Conveniently the connecting formations defined on the further portion comprise means defining two pockets separated by a reinforcing rib.

Advantageously the free edge of the further portion defines a cam face.

Preferably the under-surface of the portion of each clip directed inwardly defines a cam face and a seat to receive an edge of the length of guttering.

Conveniently two upstanding projections are provided on either side of the recess, the clip defining gaps adapted to accommodate the projections when the clip is in position.

Preferably movement of the clip is limited by engagement of the projections and walls defining the ends of said gaps.

Advantageously the exterior of the clip received in the recess portion is flush with the exterior of the rib when the clip is in position.

Preferably the guttering element and the clip can be moulded using two-part tools, the tool for the clip having movable inserts.

Conveniently the part of the rib adjacent the recess is of greater effective radius than the remaining part of the rib, the channel defined within the rib being provided with flanges upstanding from the base of the channel to enable the sealing strip to be of substantially uniform cross-section, the thickness of the plastic forming the parts of the guttering element thus being of substantially uniform thickness.

Figure 2:
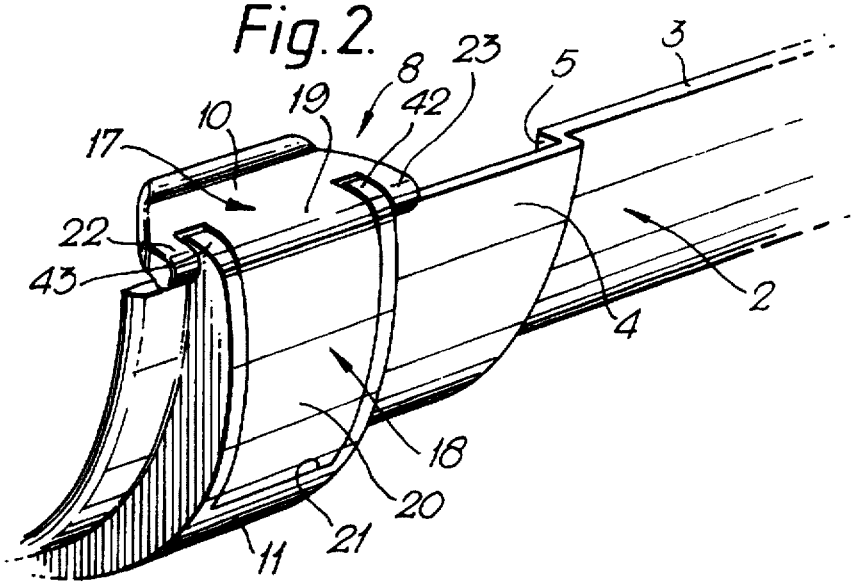
Figure 3:
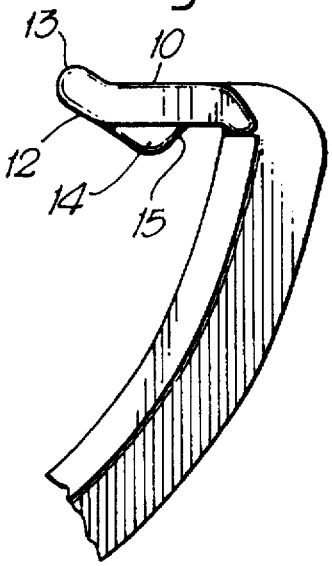
Figure 4:
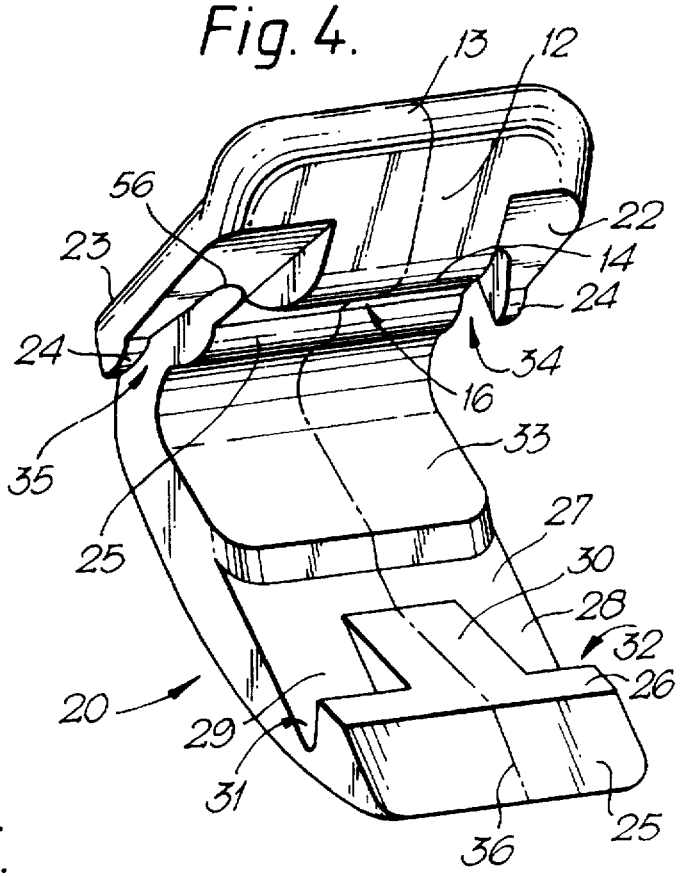
Figure 5:
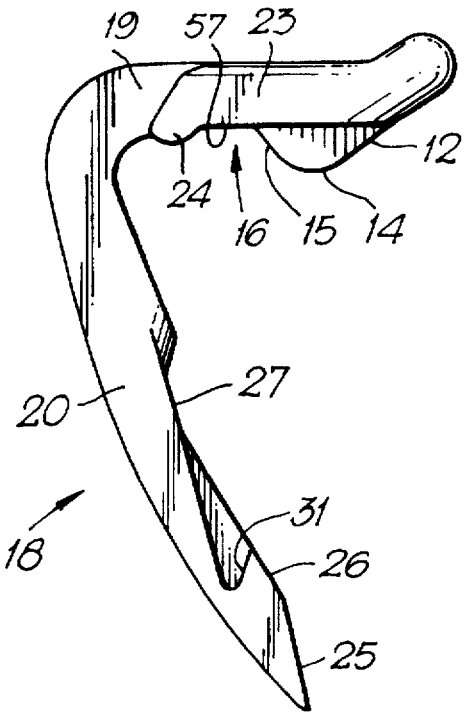
Figure 6:
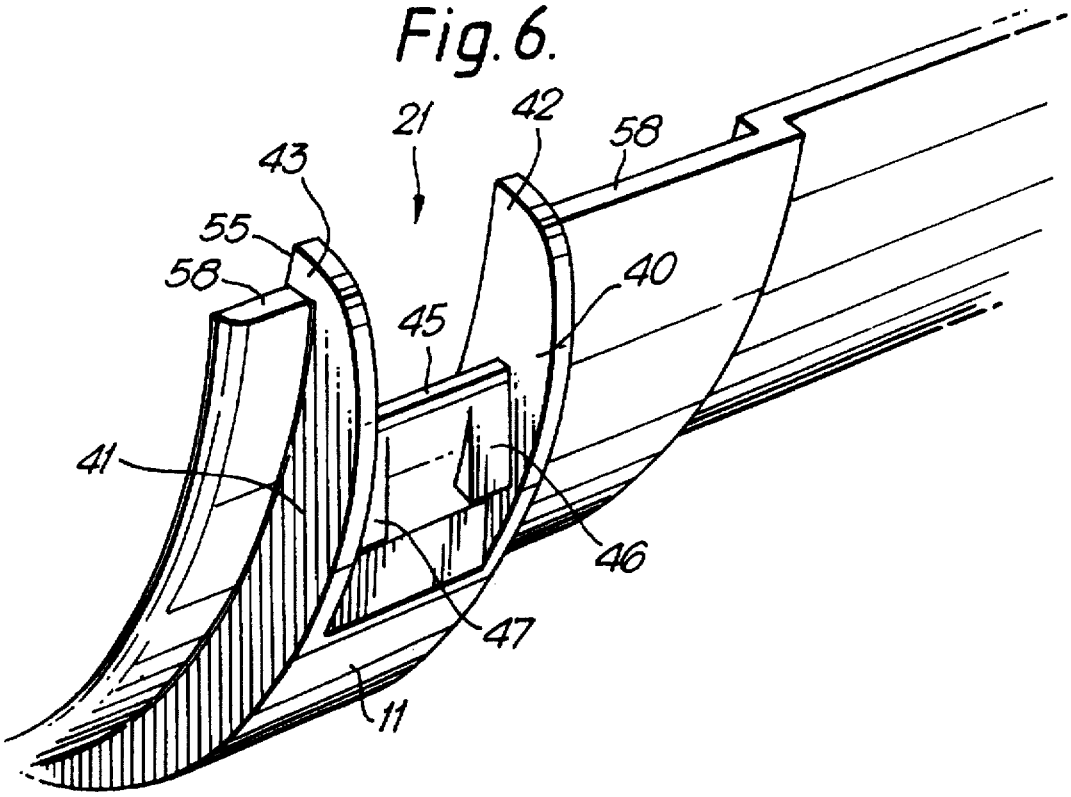
Figure 7:
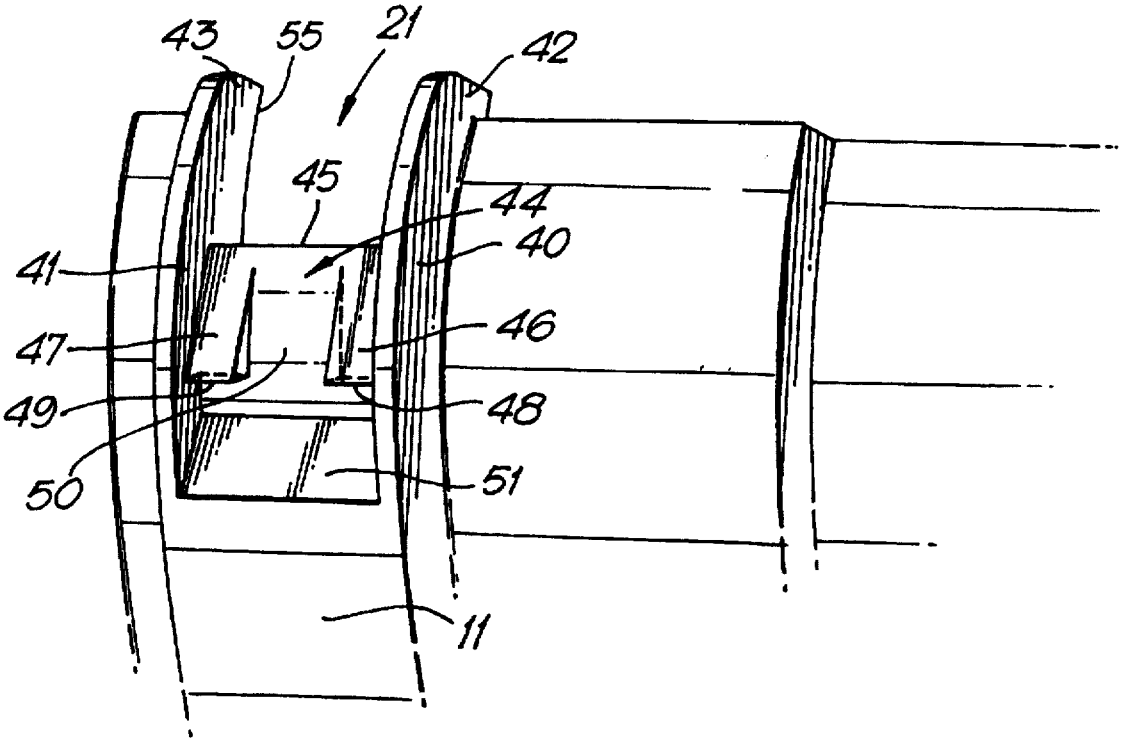
Figure 8:
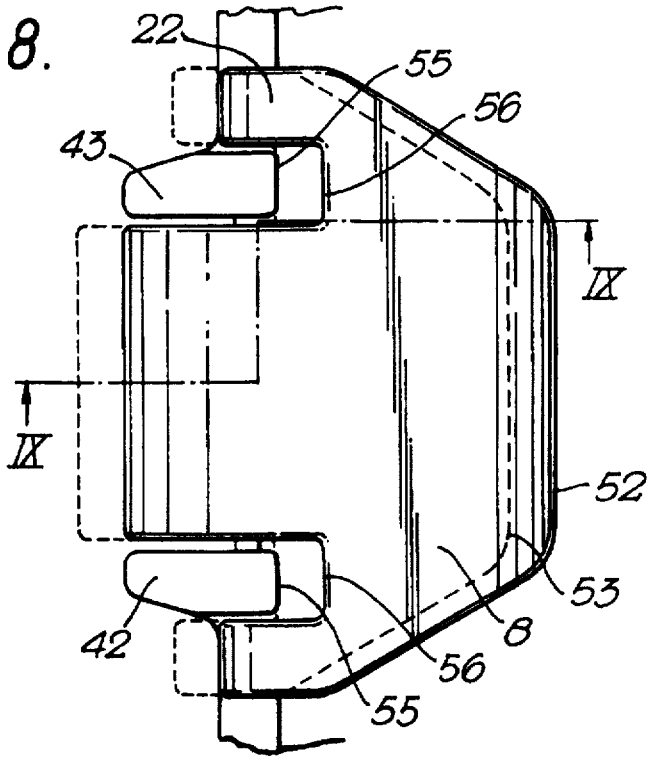
Figure 9:
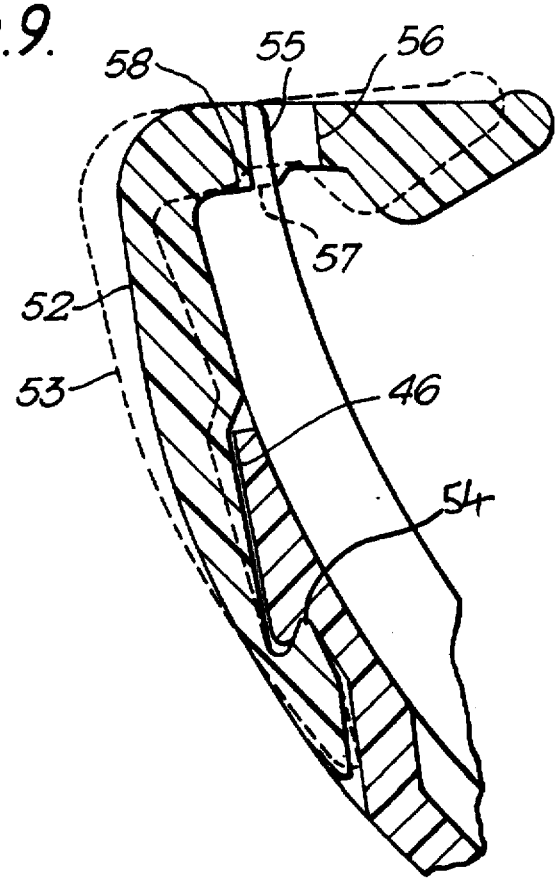
Figure 10:
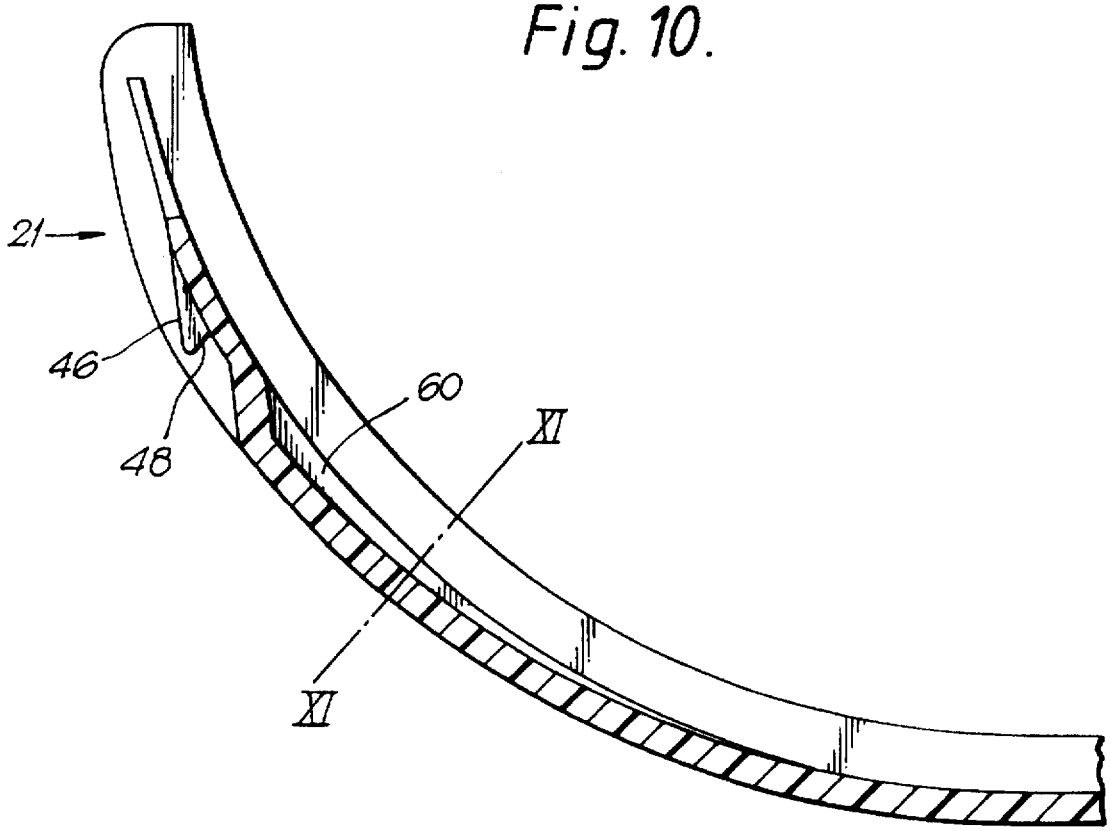
Figure 11:
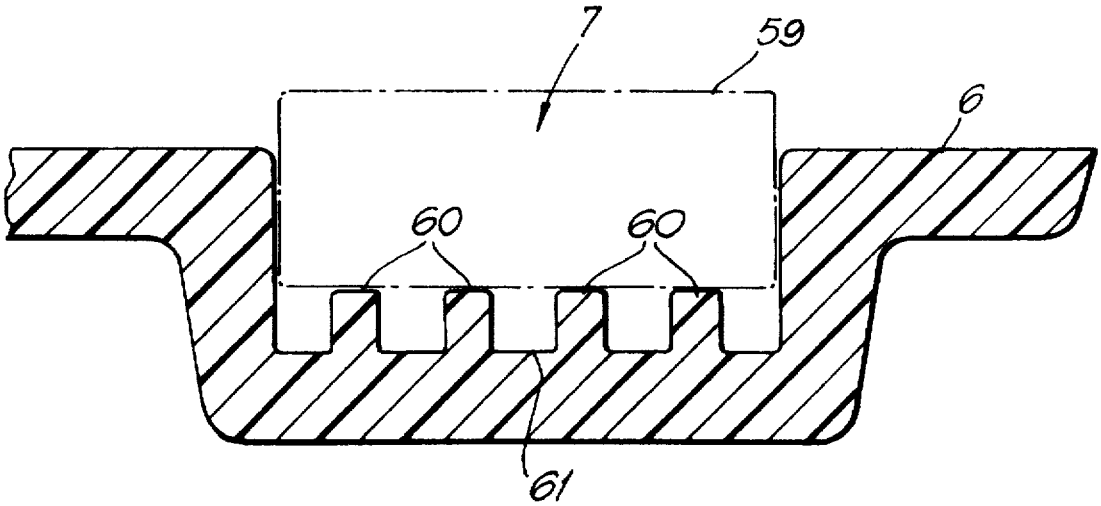
Figure 13:
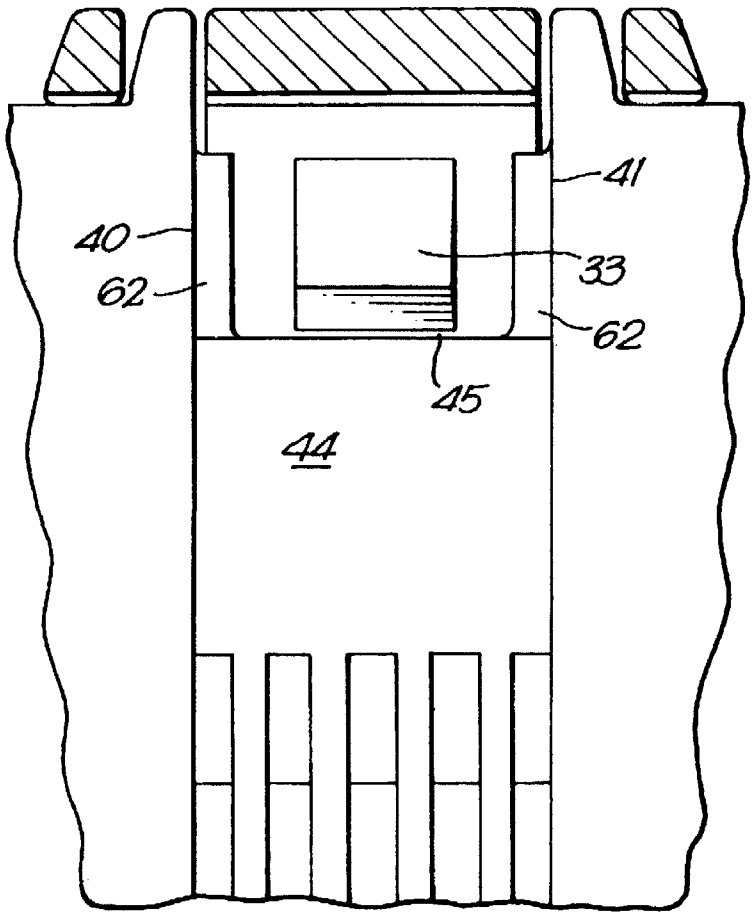
Figure 12:
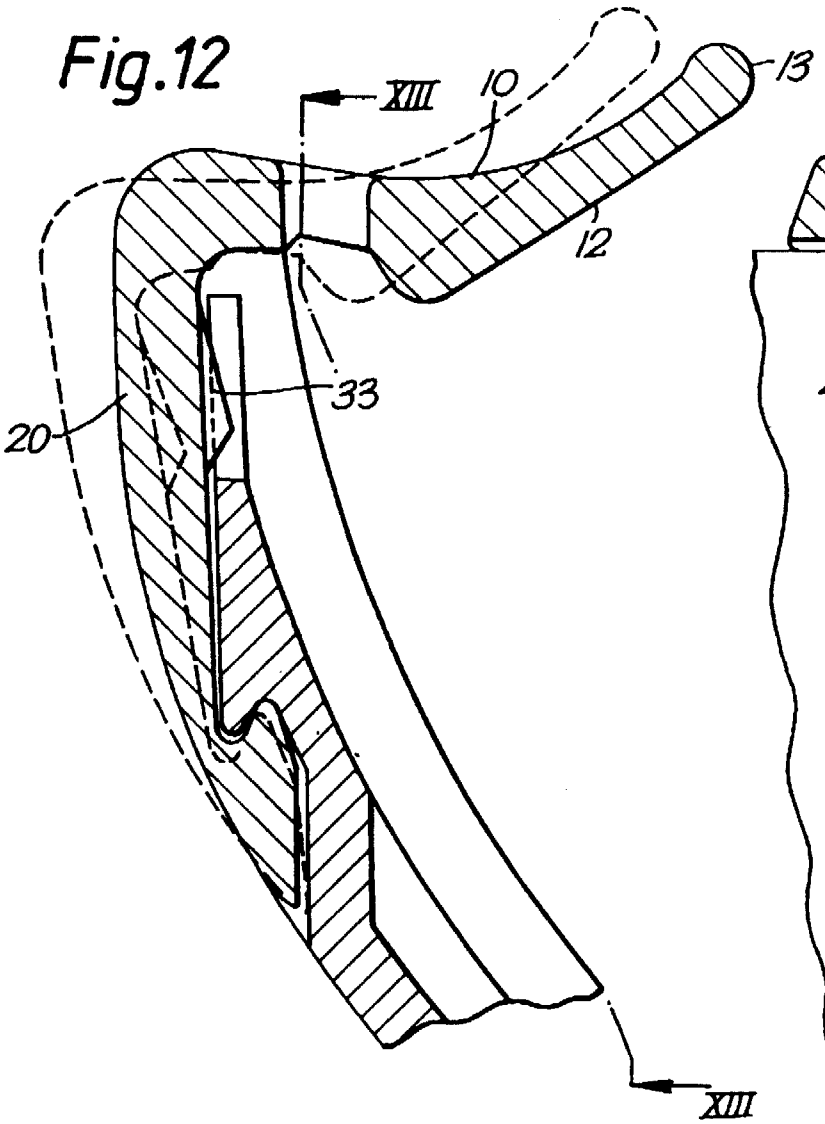

In order that the invention may be more readily understood, and so that further features thereof may be appreciated, the invention will now be described, by way of example, with reference to the accompanying drawings in which FIG. 1 is a perspective view illustrating the operative part of a guttering element forming part of a guttering system in accordance with the invention, the element having two clips mounted thereon, FIG. 2 is an enlarged perspective view illustrating part of the guttering element of FIG. 1, showing only one clip, FIG. 3 is an end elevational view illustrating part of the guttering element of FIG. 1, showing only one clip, FIG. 4 is an enlarged perspective view of a clip mounted on the guttering element of FIG. 1, FIG. 5 is a side view of the clip of FIG. 4, FIG. 6 is a perspective view of part of the guttering element of FIG. 1 with the clip removed, FIG. 7 is another perspective view of part of the guttering element of FIG. 1 with the clip removed, FIG. 8 is a top plan view of a clip mounted on the element showing one position in solid lines and another position in dotted lines, FIG. 9 is a sectional view taken on line IX—IX of FIG. 8 again showing the solid line position and the dotted line position, FIG. 10 is a part cross-sectional view of the guttering element of FIG. 1, with the clip removed taken on the line X—X of FIG. 1, FIG. 11 is a sectional view showing the seal receiving channel of the component as shown in FIG. 1 taken on the line XI—XI of FIG. 10, FIG. 12 is a view corresponding to FIG. 9 of a modified embodiment of the invention, and FIG. 13 is a view taken on the line XIII, XIII of FIG. 12.

Referring initially to FIG. 1, a guttering element 1 is illustrated which comprises a first plastics moulding 2 which defines a length of channel 3 of substantially semi-circular form, the dimensions of this channel being equivalent to the dimensions of a length of guttering forming part of a guttering arrangement.

It is to be understood that the portion 3 of the element illustrated in FIG. 1 may well comprise a length of guttering, but may also comprise part of a support bracket intended to support guttering and inter-connect two lengths of guttering, a corner element adapted to inter-connect two lengths of guttering at an angle of 90°, or some other pre-selected angle, at a corner, an end stop adapted to form an end to a run of guttering, or a down-pipe connector.

At the end of the portion 3 of the moulding 2, the moulding 2 defines an enlarged radius gutter retaining seat 4. An abutment wall 5 is defined between the seat 4 and the portion 3. The seat 4 is dimensioned to receive one end of a length of guttering of equivalent form to the portion 3, with that length of guttering being snugly received and retained, with the length of guttering being aligned with the portion 3.

The seat 4 defines a face 6 of arcuate cross-section adapted to abut against the under-side of a length of guttering inserted into the seat. The face 6 is provided with a groove or channel 7 adapted to receive a sealing strip formed of rubber or other resilient sealing material, so that the sealing strip is in firm contact with the under-side of a length of guttering received within the seat 4.

At the ends of the channel 7 the seat 4 is provided with two clips 8,9 of the same design, which are clipped in position (as will be described hereinafter) on the moulding 2. The clips 8,9 each have a portion 10 which is inwardly directed, the portions 10 extending towards each other across the seat 4 so as to engage and retain the edges of a length of guttering received within the seat 4. As will become clear from the following description the arrangement is such that when a length of guttering has been located within the seat 4, the length of guttering is firmly retained by the clips 8,9 and a good water-tight seal is provided against the under-side of the length of guttering by the sealing strip present within the channel 7.

As will become more clear from the following description, the design of the moulding 2 is such that the moulding can be produced on a two-part mould. Also, the design of the clip 8,9 is such that the clip can be produced on a two-part mould with two movable inserts. Thus, the separate parts of the component 1 illustrated in FIG. 1 can be moulded in an inexpensive manner, using inexpensive tools. The parts of the guttering element 1 may be readily assembled on site as the guttering is erected. The completed guttering element may be used in an easy and straightforward way, using conventional techniques.

Turning now to FIGS. 2 and 3 of the drawings, it can be seen that the channel 7, which opens into the arcuate surface 6 of the seat 4, is actually received within a hollow rib 11 which protrudes on the under-side of the seat 4.

The clip 8 is mounted in position at the end of the rib 11 so that the clip 8 is aligned with the seal present in the channel 7. The clip 9 is mounted in a similar position. Thus, the down force exerted by the clips on a length of guttering which is received within the seat 4 is substantially aligned with the seal present in the channel 7, thus enhancing the sealing effect.

A top portion 10 of the clip 8 extends inwardly across the seat 4 and is provided, on its under-surface (as shown in FIG. 3), with a cam portion 12 which extends downwardly from the free edge 13, the cam portion terminating in a rounded protrusion 14, there then being an upwardly directed under-surface 15 which leads to a seat 16 also defined on the under-surface of the top portion 10. The top portion 10 of the clip 8 has a substantially trapezoidal central region 17 (see FIG. 2). A centrally located mounting lug 18 extends downwardly from the edge of the trapezoidal region remote from the free edge 13. The lug 18 has a first portion 19 extending in a co-planar manner with the region 17, and a depending portion 20 carrying, as will be described hereinafter, connecting formations adapted to co-operate with corresponding connecting formations formed in a recess 21 provided for that purpose at the top of the rib 11. The said corresponding connecting formations are thus defined on the exterior of the part of the moulding 2 defining the seat 4.

The trapezoidal area 17 of the top portion 10 of the clip 8 is also provided with two rearwardly extending locating tabs 22,23 which are substantially aligned with the edges of the trapezoidal area, extending parallel and substantially co-planar with the planar portion 19 of the lug 18. The tabs 22,23 thus extend away from the free edge 13.

The tabs 22,23 are provided, on their under-edges, with terminal protrusions 24 which, as can be seen from FIG. 5, help define the seat 16. As can be seen from FIG. 4 the under-surface of part of the first portion 19 is provided with a transverse rounded protrusion 14, aligned with the terminal projections 24 on the lugs 22 and 23, again helping define the seat 16.

The seat 16 is intended to receive and retain an edge of a length of guttering to be connected to the described guttering element.

The depending portion 20 of the mounting lug 18 of the clip 8 carries (as can be seen from FIGS. 4 and 5) on its inner face various projections or connecting formations. The projections or engaging formations comprise, adjacent the lower end of the depending portion 20, an inclined ramp or cam face 25. The cam face merges into a planar face 26 which extends substantially parallel with the outer face of the depending portion. Face 26 is of "T"-shape, and merges with a further planar face 27 inclined at an angle to the face 26. The effect of the two planar faces 26,27, is that two pockets 28,29 are defined, with a reinforcing rib 30 extending between the pockets. The head of the "T" of the area 26 lies adjacent the pockets, and the stem of the "T" defines the reinforcing rib 30. The pockets define, adjacent the head of the "T", engagement faces 31,32.

The thickness of the portion 20 of the lug 18 increases, in region 33, that region merging with the portion 19 of the lug 18 that is co-planar with the trapezoidal region 17 of the top 10 of the clip 8.

It is to be noted that there are gaps 34,35 between the lugs 22,23 and the main part of the clip.

The clip 8 may be moulded using a two-part mould with movable inserts to define the gaps 34,35. The two-part mould will define a substantially central splitline, shown as the splitline 36 which extends substantially axially of the clip.

The depending lug 18 of the clip 8 is adapted to be received within a recess 21 provided at the end of the rib 11. The configuration of the recess 21 is shown more clearly in FIGS. 6 and 7.

The effect of the recess 21 is to cause the end of the rib 11 to terminate in two substantially parallel spaced apart walls 40,41 which extend above the top of the seat 4, thus forming projections 42,43. As will become apparent to the projections 42,43 are adapted to be received within the gaps 35,34 respectively.

A transverse wall 44 extends between the walls 40,41, the top 45 of the transverse wall 44 being at a level lower than the level of the top of the seat 4. The inner face of the wall 44 defines part of the seat 4.

The outer face of the transverse wall 44 carries, at its two side edges adjacent the walls 40,41 two triangular projections 46,47 each having a lower engagement face 48,49. The triangular projections are spaced apart by a central space 50. The area of the wall 44 that does not carry the projections 46,47 is substantially "T" configuration and has the same configuration as the "T"-shaped face 26 of the clip 8.

The wall 44, at its lower end, is connected to a planar wall 51 which extends substantially parallel with a vertical axis passing through the component of FIG. 1. This means that the component of FIG. 1 can be moulded using a simple two-part tool.

The clip 8 is inserted in the recess 21 simply by moving the clip vertically with the lug 18 aligned with the recess 21. As the clip moves downwardly, the projections 42,43 become received within the spaces 35,34 between the rearwardly extending lugs 23,24 and the central trapezoidal region 17 of the top 10 of the clip 8, thus guiding the clip and restricting permissible movement of the clip. As the lug 18 is received within the recess 21, the cam face 25 engages the exposed faces of the triangular projections 46,47 and rides over those faces. However, when the clip is fully in position the pockets 28,29 are co-aligned with the projections 46,47, and the clip snaps into a secured or fastened condition, with the projections 46,47 being received within the pockets 28,29. The engagement faces 48,49 on the projections 46,47 therefore engage the engagement faces 31,32 present in the pockets 28,29. The projections 42,43 are positioned within the spaces 34,35 and the clip is thus retained in position.

Referring now to FIGS. 8 and 9 of the drawings it can be seen that when the clip 8 has been mounted in position, as described above, the clip is movable between a first position 52, shown in solid line and a second position 53 shown in dotted line.

The movement between the first and second position is a rotating movement which is effected about a point which is the point 54 where the engagement faces 31,32 defined within the pockets 28,29 inter-sect the planar face 26. This point is also located at the junction of the lower engagement faces 48,49 and the outer face of the transverse wall 44. The clip 8 can effect a rotating movement about the point 54. As can be seen from FIG. 9, the rotation of the clip towards the solid line position 52 (i.e. movement in the clockwise sense as illustrated) is limited since, as the clip rotates, the face 27 present on the clip will abut the outer faces of the projections 46,47. Similarly the planar face 30 present on the clip will abut the face of the transverse wall 44. Thus forward movement in the clockwise sense of the clip is restricted. The clip can, however, move from the solid line position 52 in an anti-clockwise sense (as illustrated in FIG. 9) to the dotted line position. However, further movement in the anti-clockwise direction is prevented by the engagement of a face 55 provided on each projection 42,43, and a face 56 defined at the end of the gaps 34,35 between the lugs 22,23 and the main part of the clip 8. It is to be noted that the under face 57 present on each of the lugs 22,23 engages the top face 58 (FIG. 6) of the part of the moulding 2 defining the seat 4 on either side of projections 42 and 43.

The clip is thus, once mounted in position, securely retained in position, but is able to move between the two positions illustrated.

The clip tends to move to the position 53 shown in dotted lines when a length of gutter is being connected to the described guttering element. The clip then returns to the solid line position to retain the guttering firmly in position, with the upper lip of the length of guttering being retained within the seat 16 defined by the clip.

It is to be noted that (see FIG. 10 and 11) the presence of the recess 21 at the end of the rib 11 necessitates at least that part of the rib being of a greater "thickness" or of a greater radius than the remaining part of the rib which simply defines the channel 7 adapted to receive the sealing strip. If the channel 7 were moulded to be of a constant depth, the result would be that the thickness of the plastic in the rib 11 adjacent the recess 21 would be much greater than the thickness of the plastic forming the rest of the moulding 2. It is to be understood that it is desirable for plastic within a moulding to have a substantially uniform thickness throughout the moulding, thus assisting in the cooling of the plastic within the mould in a uniform manner. In order to avoid the provision of relatively thick plastic in the region of the rib 11, therefore, the interior of the channel 7 is provided with a plurality of upstanding flanges 60, which extend up from the base 61 of the channel 7. As can be seen from FIG. 10 the flanges 60 are of diminishing height, having their greatest height adjacent the recess 21, and reducing to virtually no height towards the centre of the moulding. The upper surfaces of the flanges 60 therefore serve to define the operative bottom of the channel 7 which receives the sealing strip, enabling a sealing strip of constant cross-section to be utilised. This means that the sealing strip 59 can be readily extruded in an uncomplicated manner.

It is to be observed that the effective thickness of the plastic forming the ribs 60 and forming the bottom of the channel 7, in other words the plastic forming the rib 11 is substantially uniform. This assists in the fabrication of the moulding 2.

FIG. 11 illustrates the sealing strip 59 in phantom in an uncompressed condition. It is to be observed that the sealing strip 59 projects above the surface 6 forming the seat 4 in an initial or uncompressed condition.

When the guttering element of FIG. 1 has been assembled, by inserting the clips 8 and 9 in position, and when there is a sealing strip 59 present within the channel 7, the guttering element 1 of FIG. 1 may be connected to a length of guttering simply by inserting the length of guttering into the seat 4, with the end of the length of guttering either in abutment with the wall 5 or in a predetermined position relative to the wall 5, to permit for expansion and contraction of the length of guttering, with one edge of the length of guttering being received in the seat 16 defined by one of the clips, for example the clip 9. The other edge of the length of guttering will then be adjacent the clip 10. The plastics material forming the moulding 2 does have a slight degree of resilience, permitting the moulding 2 to be bent outwardly or slightly flattened. This brings the edge of the length of guttering into engagement with the cam face 12 provided on the under-surface of the top 10 of the clip 8. By appropriate manipulation of the moulding 2 and the length of guttering, the edge of the length of guttering can be caused to ride along the cam face 12, past the protrusion 14, and when the edge of the length of guttering engages the second inwardly directed cam face 15, the length of guttering snaps into position with the edge of the length of guttering retained within the seat 16.

When the length of guttering is in this position, the sealing strip 59 is compressed but the upper surface of the sealing strip is still proud of the surface 6 defining the seat 4. The length of guttering is then securely fastened to the guttering element 1, and a water-tight seal is created.

FIGS. 12 and 13 illustrate a modified embodiment of the invention. In the clip shown in FIGS. 12 and 13 the design of the cam portion 12 which extends downwardly from the free end of the clip 13 has been modified. The cam 12 is of a greater extent, and is inclined at an angle greater to the horizontal. Thus, effectively, the top portion 10 of the clip extends further across the seat than in the clip described and illustrated in FIG. 9. This facilitates the insertion of the end of a length of gutter into the seat associated with the clip.

A further modification is that the thickened region 33 of the depending portion 20 of the lug does not extend the full width of the depending portion 20 of the lug as shown in FIG. 4, but instead is of reduced width, as can be seen from FIG. 13. This portion 33 co-operates with shoulders 62 provided on either side of the recess 21. The shoulders extend inwardly from the walls 40,41, extending across the recess 21 above the top 45 of the transverse wall 44. The shoulders 62 minimise the risk of accidental disassembly of the clip.

The embodiments described and illustrated represent examples of the invention. It is to be understood that changes and modifications can be made to those embodiments without departing from the spirit of the invention and such modified embodiments are intended to fall within the scope of the following claims.

What is claimed is:

1. A guttering arrangement including a guttering element defining a seat adapted to receive an end of a length of guttering, the seat being provided with a channel for receiving sealing strip to be in sealing engagement with the exterior of said length of guttering, said guttering element being provided with two separate clips mounted and retained on the guttering element, each clip having a portion directed inwardly across the seat adapted for engaging and retaining an edge of said length of guttering, each clip having a portion defining connecting formations adapted for engaging corresponding connecting formations formed on the exterior of the part of the element defining said seat, the connection formations on the clip being formed on a portion of the clip which is received in a recess formed on the exterior of a rib protruding from the under-side of the seat of said guttering element and accomodating said channel with two upstanding projections on either side of the recess, the clip defining gaps adapted for accommodating the projections when the clip engages the seat, the connecting formations being such that the clip having a limited degree of movement between a first position and a second position, a first part of the connecting formation on the clip engaging a first part of the connecting formation on the guttering element when the clip is in the first position and a second part of the connecting formation on the clip engaging a second part of the connecting formation on the guttering element when the clip is in the second position.

2. An arrangement according to claim 1 wherein the connecting formations defined on the clip comprise means defining two pockets separated by a reinforcing rib.

3. An arrangement according to claim 1 wherein the free edge of the said portion directed across the seat defines a cam face.

4. An arrangement according to claim 1 wherein the under-surface of the portion of each clip directed inwardly defines a cam face and a seat to receive an edge of the length of guttering.

5. An arrangement according to claim 1 wherein movement of the clip is limited by engagement of the projection and walls defining the ends of said gaps.

6. A guttering arrangement according to claim 1 wherein the exterior of the portion of the clip received in the recess is flush with the exterior of the rib when the clip is in the first position.

7. A guttering arrangement comprising a guttering element and a clip wherein the guttering element and the clip can each be moulded using two-part tools, the tool for the clip having movable inserts, said guttering element defining a seat adapted to receive an end of a length of guttering, the seat being provided with a channel receiving a sealing strip to be in sealing engagement with the exterior of said length of guttering, said guttering element being provided with two separate clips mounted and retained thereon, each clip having a portion defining connecting formations received in a recess formed on the exterior of said guttering element opposite said seat and having upstanding projections formed on either side of the clip, the clip defining gaps adapted to accommodate the projections, the connecting formations being formed so that the clip moves from a first position in which a first part of the connecting formation on the clip engages a surface formed in the seat of said guttering element and a second position in which a second part of the connecting formation on the clip engages the projections formed on said guttering element.

8. An arrangement according to claim 7 wherein the connecting formations on the clip are formed on a portion of the clip which is received in the recess formed in the corresponding connecting formation defined in the exterior of a rib protruding from the under-side of the seat and accommodating said channel.

9. An arrangement according to claim 7 wherein the connecting formations on said clip comprise two pockets separated by reinforcing rib.

10. An arrangement according to claim 7 wherein the under-surface of each clip defines a cam face and a seat for receiving an edge of the length of guttering.

11. An arrangement according to claim 7 wherein movement of said clip when in said first position is limited by engagement of the projections and walls defining the ends of said gaps.

12. An arrangement according to claim 7 wherein said clip additionally comprises a portion directed inwardly across the seat adapted for engaging and retaining an edge of the said length of guttering.

13. An arrangement according to claim 12 wherein the under-surface of the inwardly-directed portion of each clip is provided with a cam face and a seat for receiving an edge of the length of guttering.

14. A guttering arrangement comprising:

a guttering element having a retaining seat formed therein and first and second projection and a triangular projection formed thereon;

a length of guttering engaging the retaining seat; and a clip for retaining said length of guttering in retaining seat comprising an inwardly-directed portion having a seat formed on the under-surface thereof for engaging and edge of said length of guttering, first and second locating tabs extending from said inwardly-directed portion, first and second gaps between said inwardly-directed portion and said tabs and defining faces at the ends therefore for receiving the projections formed on said guttering element, and a mounting lug integrally formed with said inwardly-directed portion of said clip and having a pocket for receiving the triangular projection formed on said guttering element therein, said pocket forming a pivot point about which said clip rotates, rotation of said clip about said pivot point being limited by engagement of said projection with the faces defined at the end of said gaps.

15. An arrangement according to claim 14 wherein the under-surface of the inwardly-directed portion of said clip defines a cam face and a seat for receiving an edge of the length of guttering.

16. An arrangement according to claim 14 wherein said clip is provided with a face for further limiting rotation of said clip about said pivot point.

* * * * *